US007799735B2

(12) United States Patent
Segall et al.

(10) Patent No.: US 7,799,735 B2
(45) Date of Patent: Sep. 21, 2010

(54) CHEMICALLY MODIFIED MELAMINE RESIN FOR USE IN SUBLIMATION DYE IMAGING

(75) Inventors: Ronald Segall, 107 Essex Ct., Mooresville, NC (US) 28117; Brian Sparks, Mosheim, TN (US); Eric Batman, Hampton, SC (US)

(73) Assignee: Ronald Segall, Mooresville, NC (US)

( * ) Notice: Subject to any disclaimer, the term of this patent is extended or adjusted under 35 U.S.C. 154(b) by 950 days.

(21) Appl. No.: 11/443,759

(22) Filed: May 31, 2006

(65) Prior Publication Data

US 2006/0278332 A1 Dec. 14, 2006

Related U.S. Application Data

(60) Provisional application No. 60/686,503, filed on Jun. 1, 2005.

(51) Int. Cl.
*B41M 5/035* (2006.01)

(52) U.S. Cl. ..... 503/227; 8/471

(58) Field of Classification Search ..... None
See application file for complete search history.

(56) References Cited

U.S. PATENT DOCUMENTS

| | | | | | |
|---|---|---|---|---|---|
| 4,962,080 | A | * | 10/1990 | Watanabe | 503/227 |
| 5,187,144 | A | * | 2/1993 | Shinohara et al. | 503/227 |
| 5,643,666 | A | | 7/1997 | Eckart et al. | 428/339 |
| 5,762,743 | A | * | 6/1998 | Nakamura | 156/235 |
| 6,300,279 | B1 | | 10/2001 | Macedo | 503/227 |
| 6,596,116 | B2 | | 7/2003 | Macedo | 156/230 |

FOREIGN PATENT DOCUMENTS

JP 62-025089 * 2/1987

* cited by examiner

*Primary Examiner*—Bruce H Hess
(74) *Attorney, Agent, or Firm*—K&L Gates, LLP

(57) ABSTRACT

A method for transferring a decorative sublimation dye design formed on a transfer sheet to a substrate. The method comprises providing a substrate treated with a melamine resin, chemically modifying the melamine resin to produce an active dye site for acceptance of a sublimation dye, and transferring the sublimation dye to the active dye site.

17 Claims, 3 Drawing Sheets

CHEMICALLY MODIFIED MELAMINE RESIN FOR USE IN SUBLIMATION DYE IMAGING

FIELD OF THE INVENTION

The present invention generally relates to methods of applying decorative designs to substrates using sublimation dyes, more particularly to methods of applying decorative designs to laminates using sublimation dyes.

BACKGROUND OF THE INVENTION

Decorative substrates such as decorative laminates are widely used in both residential and commercial applications particularly where both an aesthetically pleasing appearance and functionality are desired. Examples of applications for decorative laminates include, but are not limited to, walls, countertops, furniture, paneling, and flooring.

Decorative laminates are classified into two categories: high pressure decorative laminates (HPDL) and low pressure decorative laminates (LPDL). As is known in the industry, high pressure decorative laminates are typically manufactured or laminated under heat and a specific pressure of more than 750 psig. Low pressure decorative laminates are typically manufactured at a specific pressure of about 300 psig. Also, high pressure decorative laminates are generally relatively thin, typically comprising a decorative surface and a phenolic resin impregnated kraft paper core. Low pressure density laminates are normally thermally bonded to a rigid substrate such as particle board or medium density fiberboard (MDF). High pressure decorative laminates are bonded to a rigid substrate by an adhesive and require an additional fabrication step. Low pressure decorative laminates are comprised of a decorative surface bonded to a substrate such as particleboard or MDF. A low pressure decorative laminate does not have a supporting core layer as does a high pressure decorative laminate. Also, there is typically only a single laminating or pressing operation during fabrication of a low pressure decorative laminate.

High pressure and low pressure decorative laminates are traditionally manufactured in heated, flat-bed hydraulic presses. As is known in the industry, high pressure laminates are typically pressed as multiple sheets in press "packs" or "books" in a multi-opening press which is usually steam or high pressure hot water heated, and water cooled, with a 30 to 60 minute thermal cycle and 130° C. (266° F.) to 150° C. (302° F.) top temperature. Low pressure decorative laminates are typically pressed as a single sheet or "board" in a single opening press using an isothermal, hot discharge "short cycle" of 30 to 60 seconds with press heating platen temperatures of 180° C. (356° F.) to 220° C. (428° F.). Continuous laminating or "double belt" or "double band" presses for decorative laminate manufacture have similar "cycle" times and temperatures as those employed for low pressure decorative laminates. Continuous laminates are relatively thin, without direct bonding to a substrate. Continuous laminates require a second fabrication step as do conventional high pressure decorative laminates.

The typical construction of a continuous laminate is a melamine-impregnated, alpha cellulose overlay plus a paper superimposed over one or more phenolic resin impregnated papers. The thickness of the laminate, which is normally in the 1/32" range, is ultimately determined by the layers of papers and the resulting amount of resin absorbed. When the sheet is pressed, a steel caul plate is used to create a surface finish ranging from high gloss smooth to fully textured. Continuous laminates can be rolled, but only into larger diameter rolls. When decorative papers are prepared for use in lamination they are typically digitally printed, offset printed, gravure printed, pad coat printed or silk screened.

There are known methods for transferring a design formed on a transfer sheet to a substrate using sublimation dyes. Sublimation is a process through which solids transform directly into gases without going through an intermediate liquid state. For example, a sheet of cellulose web material such as paper impregnated with a thermosetting resin is applied to at least one surface of a substrate. While the surfaces are in contact, the resin-impregnated paper is consolidated to the substrate under heat and pressure such that the resin seeps into the pores of the substrate to form a thermofused substrate. Thus, the term "thermofuse" generally refers to applying heat and pressure to bond material together. A transfer sheet is brought into contact with the surface of the thermofused substrate. Heat and pressure are applied to the transfer sheet and thermofused substrate through a sublimation process. The transfer sheet is separated from the surface of the thermofused substrate. Optionally, a protective coating is applied over the surface of the substrate showing the transferred design. The design is transferred and penetrated into the surface of the substrate at a temperature and a pressure readily determined by one of ordinary skill in the art.

U.S. Pat. No. 6,300,279 describes a method for transferring a decorative sublimation dye design formed on a transfer sheet to a wood substrate by applying a sheet of cellulose web material impregnated with a thermosetting resin to at least one surface of a wood substrate.

U.S. Pat. No. 6,596,116 describes a method for transferring a sublimation design formed on a transfer sheet to a continuous laminate by using a sublimation dye.

There are also practical advantages to coloring a substrate with a sublimation dye as opposed to simply adding a coat of color film to the surface of a substrate. The dye sublimation method results in more permanent color, as there is no film coat to abrade or fade. By using a sublimation dye that vaporizes when heated, the decorative design may be made to penetrate or bleed into the body of the substrate. Also, the dye sublimation method does not physically alter the surface of the substrate, for instance, adding a coat of color film would. Still yet, there is no significant change in the weight of the substrate colored.

Although polyester tends to have performance properties very similar to melamine, it is known that in contrast to melamine, polyester is receptive to image imprinting with sublimation dyes. Polyester based laminates and decorative surfaces readily receive imaging from dye sublimation printing. Within the crystal matrix of the polyester structure are available sites for the sublimed particles to reside after cooling. In the industry, the dye sublimation printing process has not worked effectively with melamine based laminates. Since the high pressure laminate market widely accepts melamine based laminates as the dominate market standard, the ability to use dye sublimation printing on a melamine based laminate would have significant commercial benefits. A primary benefit would be to use the dye sublimation imaged product as a standard laminate in an application. A polyester resin material is difficult, if not impossible, to thermofuse to certain substrates that are requisite to furniture manufacturing, architectural products, and other industries. A melamine resin can more readily achieve a thermofused bond due to more compatible condition requirements such as temperature and pressure to create a chemical bond, as necessary to thermofuse substrates such as particle board, engineered woods, phenolic backers, cement board, plastics, polymers, and various other substrates.

Furthermore, melamine has greater market acceptance in fields where a thermofused or laminated substrate is utilized than does polyester. While polyester resin is capable of thermofusing, alone it does not contain adequate properties such as durability, and polyester treated material is typically more expensive than melamine treated material. Another difficulty with thermofusing polyester lies in thermofusing the same onto a phenolic back in that the required cure temperature and pressure required for polymerization of phenolic and polyester are different. Thus, there is a need to be able to make a thermofused bond onto various substrates, including phenolic, which is so difficult to achieve with polyester.

However, until now, melamine could not effectively be used for imaging with sublimation dyes. The present invention attempts to solve this problem by achieving a modified melamine resin for use in sublimation dye imaging that mimics the ability of polyester to accept a dye.

SUMMARY OF THE INVENTION

The present invention relates to a modified melamine resin substrate that is suitable for use in dye sublimation imaging and a method for transferring a decorative sublimation dye design formed on a transfer sheet to the substrate. The method comprises providing a substrate treated with a melamine resin, modifying the melamine resin to produce an active dye site for acceptance of a sublimation dye, and transferring the sublimation dye to the active dye site.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENTS

Figure 1:
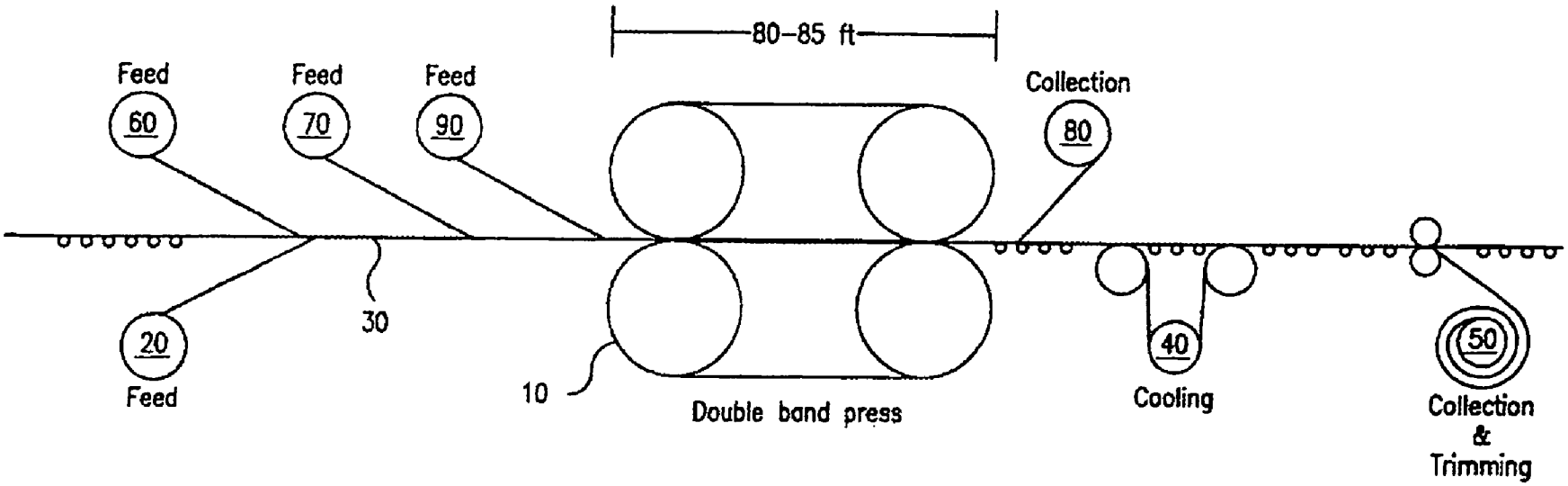
FIG. 1 is a schematic drawing of a double band press used to consolidate a cellulose web material impregnated with a thermosetting resin to a web substrate under heat and pressure to form a thermofused substrate.

The following description of the preferred embodiment(s) is merely exemplary in nature and is in no way intended to limit the invention, its application, or uses.

The method of the present invention comprises chemically modifying a surface treated with a melamine resin to create an active dye site. The term "active dye site" describes a site that readily accepts a dye. Thus, an active dye site allows a dye to penetrate and remain within the substrate such that the melamine resin mimics the ability of a polyester to accept a dye. Melamine is the common name for 2,4,6-triamino-1,3,5-triazine. It is a trimer of cyanamide and condenses with formaldehyde to give a thermosetting resin. The method of the present invention may comprise chemically modifying the melamine resin to create a chemically active endgroup, an unreacted monomer, an irregularity in the crystallinity of the melamine matrix, or a combination thereof, which in turn creates an active dye site. A polymer with very long chains of regular repeating units may form a highly crystalline structure. Modification of the melamine resin may occur via the addition of a chemical component to change the mole ratio of formaldehyde to melamine creating additional hydroxyl endgroups or crystallinity useful for successful dye sublimation. An example of a modifying chemical component is a plasticizer. Examples of plasticizers include, but are not limited to, glycols such as polyethylene glycol and diethylene glycol. Also, other chemicals may be used to further enhance the links or endgroups needed for successful dye sublimation.

Any method for modifying melamine resin to create an active dye site for acceptance of a sublimation dye such that the resulting modified melamine resin surface may be used in dye sublimation imaging is within the scope of the present invention. One such method in accordance with the present invention comprises reducing the mole ratio of melamine-urea-formaldehyde resin to a level that effectively reduces the average chain length in the polymer chain. The mole ratio of melamine-urea-formaldehyde resin may be reduced from a typical level of about 1.75 to 1.80 mole ratio of formaldehyde to urea-melamine (F/UM) to a level of about 1.10 to about 1.40 (F/UM)

In the case of a decorative laminate, the melamine resin may be present in the overlay layer in an amount of about 60 to 80% by weight and in the color paper in an amount of about 45 to 55% by weight. The kraft paper is typically present in an amount of about 70 to 150 lbs per ream wherein the pounds per ream is based on the weight of the dry paper only.

Another method of modifying melamine resin in accordance with the present invention comprises adding a high concentration of glycol(s) to the melamine resin. A high concentration may refer to 0.02% to 0.06% as a component in the initial resin mixture. A preferred glycol is diethylene glycol.

Although directionally this gives dye sites for sublimation printing and is within the scope of the present invention, the laminate produced may be hydroscopic and may effect the amount of moisture retained in the laminate. Hydroscopic refers to the ability of a material to absorb water. The presence of glycol greatly increases the ability of a laminate to absorb water. When a cellulose based material absorbs water, for example, it becomes dimensionally unstable in many applications.

Another method of modifying melamine resin in accordance with the present invention comprises combining a polyester resin with a melamine resin and curing the resin combination. This method provides for both polyester and melamine active dye sites. Preferably, the polyester melts and mixes with the melamine resin in the decorative layer of the laminate. An example of suitable operating conditions in a continuous press is about 170° C. and 400 psi with a residence time of 45 seconds and in a flat press of about 130° C. to 150° C. with a pressure greater than 750 psig and a thermal cycle between 30 and 60 minutes.

This has additional advantages in production where standard raw materials can be used and stored and the polyester sheet added at the time pressing. Preferably, the polyester is a polyethylene terephthalate (PET), more preferably, glycol-modified polyethylene terephthalate.

PETG is a glycol-modified polyethylene terephthalate that is commercially available from Eastman Chemical Company in Kingsport, Tenn. PETG, for example, may be extruded as continuous film or sheet. U.S. Pat. No. 5,643,666, incorporated herein by reference, discloses the chemical composition of the PETG copolyesters as polyethylene terephthalate polyesters modified with cyclohexanedimethanol repeat units, with the cyclohexanedimethanol being either the cis-or trans-, 1,3-or 1,4-isomers (or mixtures thereof). The main dicarboxylic acid monomers are terephthalic acid or dimethylterephthalate, and the main diol monomers are ethylene glycol and cyclohexanedimethanol, although lesser amounts of other dicarboxylic acids (or their esters) and diols can also be included in the formulation. The PETG copolyester sheets of the '666 Patent are glass-like in transparency and suitable for use in decorative glazing applications. At room temperature, the PETG sheets are extremely tough and resilient, similar to polycarbonate materials, while under pressure at elevated temperatures on the order of those used for conventional high pressure density laminate (HPDL) manufacture, they soften, melt and flow. Conversely, with conventional polyethylene terephthalate, the melt polymerization reaction product of terephthalic acid or dimethylterephthalate and ethylene glycol has a melt temperature of about 260-270° C. Although PETG is available in various grades and thicknesses that can be used for the present invention, it is preferable to use Eastar PETG Copolyester 6763, which is also available from the Eastman Chemical Company.

The polyester and melamine resins may be added separately in a two pass treating operation for the decorative paper. The paper is saturated in melamine. Then in the second pass, a coating of polyester is added. The weight percent of the polyester to the total resin may be between 2% and 4% by weight. Flat pressing conditions for this combined laminate may be about 130° C. to 150° C. with pressure greater than 750 psig and a thermal cycle between 30 and 60 minutes.

According to this method, two polymers are applied to the face sheet of a decorative laminate. Preferably, the polymers have dissimilar physical properties. For example, the glass transition temperatures of the polymers may be different but yet similar enough to allow melting at a single temperature. This application occurs before thermal processing. The process conditions such as temperature, pressure, and residence time are readily determined by one of ordinary skill in the art. According to the method, the base polymer sheet may be saturated in melamine resin and another polymer comprising a polyester or a mixture of a polyester and at least a second material. The second material may include, but is not limited to, an epoxy or a polymer such as polyvinyl chloride (PVC), acrylic, polyvinyl butyral resin, or a combination thereof. Other additives may also be present in the laminate sheets such as aluminum oxide. This method may provide for enhanced chemical resistance and good wearability of the laminate while enhancing a brilliant visual or pearlescent appearance yet allowing for dye sublimation imaging.

The term "chemically modified" also includes, but is not limited to, modification of the melamine surface by the application of a material under heat and pressure to the melamine treated surface to thermofuse the melamine and material together. For example, the method of the present invention may comprise adding a polyester in solid form with or without other materials, with the polyester preferably of a sufficiently small particle size, to the melamine resin to form a laminate. The particle size is important because the microcracks and pin-holes in the melamine surface are filled by these particles of polyester. These solids are retained on the top surface, with the melamine resin and other additives through the pressing process. When heat and pressure are applied, the polymers melt and flow under heat and pressure in the pressing process mixing the melamine to create a micro-film on the surface of the laminate. The polyester may be delivered by pressing a polyester coated release sheet at the top layer. The surface of the decorative laminate comprises, the polymer which melts and flows in the high pressure press to form a surface layer. The typical concentration in the surface layer is 0.5 parts polymeric resin per 10 parts dry paper weight. This modification to the surface of the melamine based laminate allows dye sublimation printing to produce acceptable imaging.

In accordance with the present invention, a decorative laminate comprising a modified melamine, either in sheet form or continuous form, may be prepared by any sublimation dye image method known to one of ordinary skill in the art. The laminates produced by the method of the present invention are materials that may be imaged by dye sublimation into laminates of both sheet and rolled goods. For example, U.S. Pat. No. 6,300,279 describes sheet materials and is incorporated herein by reference.

Once the melamine resin of the substrate has been chemically modified to achieve an active dye site, imaging using sublimation dyes may occur to form a decorative substrate. According to one method for transferring a decorative sublimation design formed on a transfer sheet to a thermofused or phenolic substrate, a sheet of cellulose web material impregnated with a thermosetting resin may be applied to at least one surface of a substrate. Phenolic substrate or sheet is a hard dense material made by applying heat and pressure to layers of paper or glass cloth impregnated with synthetic resin. These layers of laminations are usually of cellulose paper, cotton fabrics, synthetic yarn fabrics, glass fabrics or unwoven fabrics. When heat and pressure are applied to the layers, layers are transformed into a high pressure thermosetting industrial laminated plastic.

The thermosetting resin impregnated sheet of cellulose web material is consolidated to the phenolic substrate under heat and pressure such that the thermosetting resin seeps into the pores of the substrate to form a thermofused substrate. The transfer sheet is brought into contact with the surface of the thermofused substrate and heat and pressure are applied to the transfer sheet and thermofused substrate to cause penetration of the design on the transfer sheet into the thermofused substrate through a sublimation process. The transfer sheet is then removed from the surface of the thermofused substrate.

U.S. Pat. No. 6,596,116, which is incorporated herein by reference, relates to continuous laminates. In the '116 Patent, a sheet of cellulose web material such as paper impregnated with a thermosetting resin and is applied to a surface of a backer sheet such as latex to form a pre-laminate. The impregnated cellulose web material may also include an aluminum oxide which may improve performance measurements such as wear resistance. A release sheet is then applied to the exposed surface of the sheet of cellulose web material. The transfer sheet bearing the decorative sublimation dye design is applied to the exposed surface of the release sheet.

Heat and pressure are applied to the pre-laminate layered with the release and transfer sheets. The application of heat and pressure causes the cellulose web material to seep into the pores of the backer sheet to form a thermofused continuous laminate, and causes the design on the transfer sheet to penetrate the thermofused continuous laminate through a sublimation process. The thermofusing and sublimation processes occur substantially simultaneously at a temperature and a pressure readily determined by one of ordinary skill in the art.

The release and transfer sheets are then separated from the thermofused continuous laminate showing the transferred design.

A protective coating such as, for example, a UV cured polyester topcoat, is applied over the surface of the thermofused continuous laminate showing the transferred design. The thermofused continuous laminate showing the transferred design is then available for bonding with an adhesive, for example, to a substrate such as plexiglass, glass, PVC, acrylics, cement, wood, engineered wood substrates and plastics. Examples of wood substrates suitable for binding with a thermofused continuous laminate include, but are not limited to, MDF, plywood, isoboard, veneer core, hard board, and particle board, although many other types of wood substrates are also suitable.

Decorative thermofused continuous laminates prepared in accordance with the '116 Patent can be used to decorate virtually any substrate by bonding the continuous laminate to the substrate with an appropriate adhesive. Pre-decorated thermofused continuous laminates may be stored easily in inventory as compact rolls, which have indefinite shelf lives and which may easily be bonded with an adhesive to any one of many different substrates at a future date. Moreover, decoration with sublimation dyes need not be limited to substrates that will not melt or distort under the high temperatures required for the sublimation process. The substrate may also need not be present during the laminating process but rather may be bonded to the thermofused continuous laminate after the laminating process has already taken place. FIG. 1 illustrates a double band press which may be used to apply heat and pressure to bring about thermofusing and sublimation.

Referring to FIG. 1, a double band press 10 is illustrated for use with continuous laminates. The double band press 10 is used to apply heat and pressure to bring about thermofusing and sublimation in accordance with the present invention. An example of a double band press that is suitable for use in the present invention is the Hymmen Press, manufactured by Hymmen, a German company. The use and operation of a double band press of this type is known to those of ordinary skill in the art.

In a preferred method of the present invention, the double band press 10 is used to apply heat and pressure to bring about thermofusing and sublimation. For example, a latex backer sheet may be wound around a feed reel 20 and, during the operation of a web conveyor belt 30, the latex backer sheet is extended across the surface of the web conveyor belt 30. The partially cured cellulose web material impregnated with chemically modified melamine resin is wound around feed reel 60 and, during operation of the web conveyor belt 30, the web-material is extended on top of the backer sheet. The release sheet is wound around a feed reel 70 and is extended on top of the sheet of cellulose web material through the double band belt press 10. Polyethylene film with a thickness of about 2 mil is an example of a release sheet material that may be used in the present invention. The transfer sheet having the sublimation design is wound around a feed reel 90 and is extended on top of the release sheet.

As illustrated in FIG. 1, reels 20, 60, 70 and 90 feed and reels 40, 50 and 80 pull the various sheets through the double band press 10, wherein the sheets are exposed to heat and pressure. The heat to which the sheets are exposed and pressure may vary. The application of heat and pressure in the double band press 10 typically causes the cellulose web material to seep into the pores of the backer sheet to form a thermofused continuous laminate. Simultaneously, the application of heat and pressure in the double band press 10 typically causes the design on the transfer sheet to pass through the release sheet and penetrate the thermofused continuous laminate through a sublimation process.

The velocity of the web conveyor belt 30 is decreased or increased in order to increase or decrease, respectively, the time during which the sheets are exposed to heat and pressure in the double band press 10. One of ordinary skill in the art would know that different kinds of presses of varying lengths and different combinations of temperature, pressure and time can be used within the scope of the present invention.

Referring again to FIG. 1, as the transfer sheet and the release sheet pass through the double band press 10, and after the lamination and sublimation processes are complete, the transfer and release sheets are separated from the thermofused continuous laminate showing the transferred design by collection of the sheets onto a collection reel 80. As thermofused continuous laminate bearing the sublimation design passes through the double band press 10, it is cooled in cooling reels 40. After cooling, the thermofused continuous laminate is collected onto a collection reel 50. Once the desired length of thermofused continuous laminate bearing the sublimation design is collected on collection reel 50, it may be trimmed from the double belt press 10 using techniques known to those of ordinary skill in the art.

Figure 2:
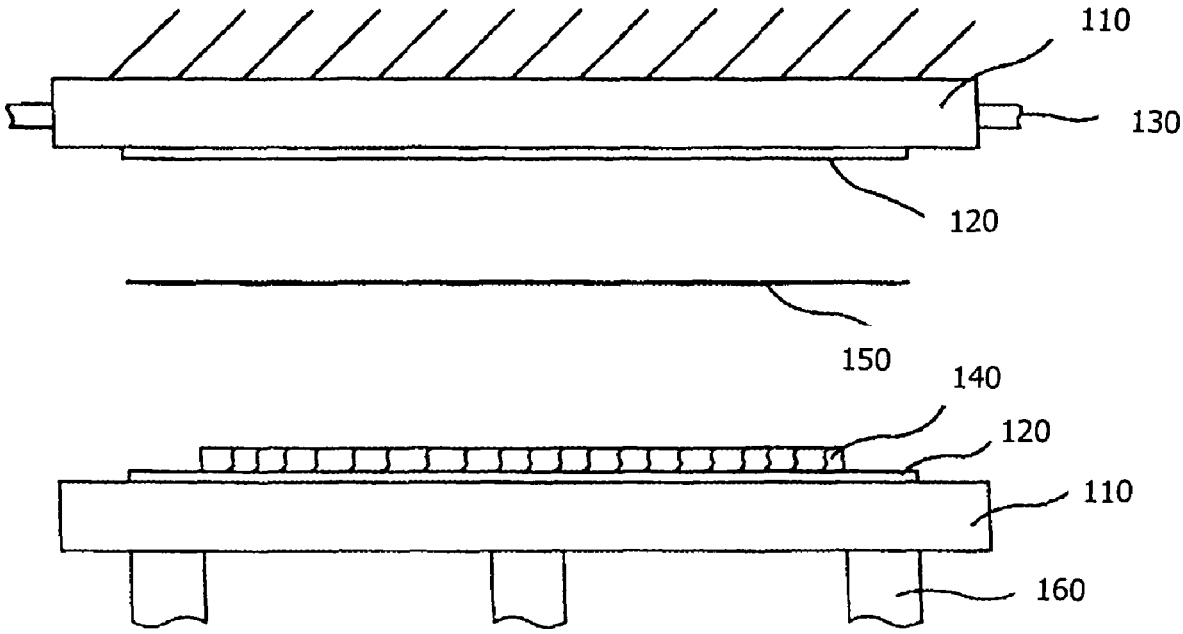
FIG. 2 is a schematic drawing of an oil press used to consolidate a cellulose web material impregnated with a thermosetting resin to a web substrate under heat and pressure to form a thermofused substrate.

FIG. 2 is a schematic drawing of an oil press used to consolidate a cellulose web material impregnated with a thermosetting resin to a web substrate under heat and pressure to form a thermofused substrate.

Referring to FIG. 2, two oil press platens 110 are positioned opposite each other. A smooth surface press platten 120 is affixed to the surface of each platen which faces the opposite platen. Placed between the two smooth surface press plattens 120, juxtaposed against the surface of one of the smooth surface press plattens, is a substrate 140. Placed between this substrate and the opposite smooth surface press platten 120 is the resin-impregnated paper 150.

The resin-impregnated paper 150 is consolidated to the substrate under the heat and pressure of the oil press such that the cellulose web material seeps into the pores of the substrate 140 to form a thermofused substrate. Hydraulic rams 600 press the platens together, thereby pressing together the resin-impregnated paper and the substrate. One of the platens is heated (and cooled) by oil which enters the platen cavity via water ducts 130. Depending on the type of substrate, a particular pressure and temperature is maintained for the time required for the resin to seep into the pores of the substrate to form the thermofused substrate. It is well within the skill of the person of ordinary skill in the art to determine the conditions to effect the desired seepage of the thermosetting resin into the pores of the substrate. The platens are then cooled and pulled apart to their original position, and the thermofused substrate is removed from the oil press.

Figure 3:
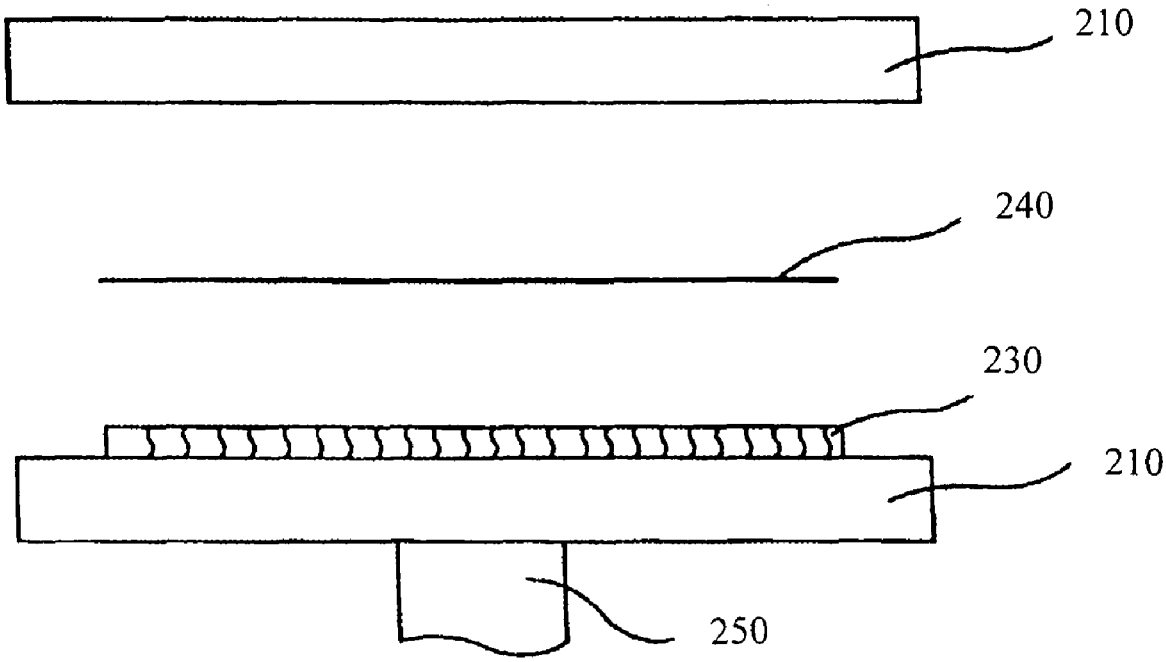
FIG. 3 is a schematic drawing of an electric press used to transfer a sublimation dye design from a transfer sheet to a thermofused substrate under heat and pressure.

FIG. 3 is a schematic drawing of an electric press used to transfer a sublimation dye design from a transfer sheet to a thermofused substrate under heat and pressure. While not capable of reaching temperatures and pressures as high as the oil press referred to in FIG. 2, allows for a more even distribution of temperature and pressure than the oil press. Referring to FIG. 3, two electric press platens 210 are positioned opposite each other. Placed between the two platens, juxtaposed against the surface of one of the platens, is the thermofused substrate 230. Placed between the thermofused substrate and the opposite platen is the transfer paper 240 which holds the sublimated dye decoration.

The electric press applies heat and pressure to the transfer sheet 240 and thermofused substrate 230 to cause penetration of the design on the sheet into the substrate through a sublimation process. A hydraulic ram 250 presses the platens together, thereby pressing together the transfer sheet and the thermofused substrate. The platens are heated via electric current which runs through the platens. Depending on the type of substrate, a particular pressure and temperature is maintained for the time required for the design to penetrate the thermofused substrate. It is well within the skill of the person of ordinary skill in the art to determine the conditions to successfully complete the sublimation process.

The transfer sheet is separated from surface of the thermofused substrate. After the sublimation process, the platens are allowed to cool. Once cool, the platens are pulled apart to their original position. The transfer sheet is then separated from surface of the thermofused substrate and the thermofused substrate removed from the electric press.

The invention is particularly advantageous in that it allows for the simultaneous occurrence of thermofusing and sublimation, or for the thermofusing process prior to the sublimation process in a separate step, yet still has the ability to use a chemically modified melamine resin in the dye sublimation imaging process.

EXAMPLES

Prophetic Example 1

Low Mole Ratio of Melamine-Urea-Formaldehyde Resin

A method of modifying melamine resin may be conducted as follows to obtain a low mole ratio of the melamine-urea-formaldehyde resin. The method may comprise charging into a stirred reactor a 50% aqueous formaldehyde (150.0 lb) and water (20.0 lb), adjusting the pH to 7.0-8.0, and heating the mixture to 80° C. Melamine (150.0 lb) is then added slowly while the reaction temperature is maintained at 80 to 90° C. (F/M=2.1). After the melamine is completely dissolved, the temperature is increased to 90° C. in 20 minutes and held, while the pH is kept at 8.3-8.6. The water dilutability of the reaction mixture reached a value of 1:2, resin to water, in 70 minutes. The reaction product is cooled to 60° C. and adjusted to pH 8.5. Urea (59.0 lb) is added and the reaction mixture mixed at pH 8.5 and cooled to room temperature to arrive at resin $MFU_2$ [F/(U+M)=1.15].

Prophetic Example 2

High Concentration of Glycol

A method of modifying melamine resin may be conducted as follows: 200 parts melamine, 193 parts formaldehyde (37%), 136 parts water, 20 parts DEG and 20 parts PEG would be combined. The DEG and PEG are added to the preparation at the melamine addition step.

Prophetic Example 3

A laminate comprising a modified melamine may be prepared as follows. Kraft paper would be obtained and saturated with a phenolic resin. The decorative sheet would be saturated with the modified melamine resin and dried to a "B" staged polymerization. By "B staged" refers to the point in the polymerization at which the material becomes handleable (i.e. the resin does not flow out of the substrate at room temperature).

These two impregnated materials would be processed in a roll form and sheeted into rectangular sheets of approximately 4 feet by 8 feet dimension.

The two materials, either in roll form or sheet form, would be layed-up or in sheet form placed into books and separated by textured plates and/or release sheets.

The material would then be placed into a press. The press temperature would be operated in a range of about 170° C. to 210° C. The pressure is regulated at about 700 psi to 1,500 psi. The residence time would be approximately one hour. The continuous press process would run at lower pressure and lower residence time due to a highly reactive catalyst.

The thermofused sheets or roll material would be removed from the press and sanded on the phenolic side to improve adhesive properties. The material would be ready for dye sublimation.

Example

Laminate A was constructed of kraft paper based layers of material with resin impregnation. Starting with the backside or bottom of the laminate, laminate A was constructed of: two layers of 180 lb kraft paper from Westvaco saturated in a phenolic resin; one layer of 80 gram decorative white saturating grade paper from Interprint; and one layer of aluminum oxide overlay paper from Mead. The two layers of 180 lb kraft paper were saturated in the phenolic resin to 35 weight percent wherein the weight percent was based on the weight of resin relative to the total weight of the saturated product. The layer of 80 gram decorative white saturating grade paper was saturated with 11 weight percent melamine wherein the weight percent was based on the weight of resin relative to the total weight of the saturated product. The calculation used was (saturated weight−dry paper weight)/(saturated weight)× 100%. It was the percent weight of resin relative to the total weight of the saturated product.

The overlay paper was fully saturated in melamine and added on top. The phenolic and melamine resins were obtained commercially from Arborite in Temple, Tex.

The phenolic resin and melamine resin were added to the kraft paper and decorative layer paper through a dip bath. The level of resin was controlled by removing excess resin with Mayer Rod, steel rods wrapped with wire used to scrap excess resin from a sheet of paper during impregnation. The resins were B-staged in dyers. "B-staged" refers to a measure of cure for a thermoset resin that is measured in terms of volatile content and flow. The kraft papers were tested at 6%-8% volatile content and the decorative sheet and overlay sheet were targeted at 34%. The flow test was subjective but showed that the resin would flow at 350° F and 1,200 psi. The construction of laminates B, C, and D were the same as the construction of laminate A except that in laminates B, C, and D sheets of the Eastman Kodak EASTAR®, a PET/PETG polyester copolymer, were added as the top layer(s). One sheet was equivalent to 0.5%

The difference between each of B, C, and D was the quantity of Kodak Eastman sheets used in the process. For each of the samples B, C, and D, each sheet of PET/PETG polyester copolymer represented 0.5% polyester by weight add-on. Weight was calculated based on the melamine weight in the top layer. It represented the weight percent of polyester relative to total resin in the top layer The component sheets of each laminate were placed into a press at 350° F. and 1,200 psi for a residence time of 45 minutes. There was a 6 minute cooling cycle at the end. The press type was a multi-opening daylight press with 12 cavities:

Each of the laminates was dye-sublimation imaged. The dye-sublimation image quality of the laminates was assessed by visual inspection. The number of sheets used was determined by weight of the melamine. One sheet of the Kodak Eastman material brought the polyester content on the surface up by approximately ½% relative to the weight of the melamine on the top level. It was found that four sheets brought the polyester level up to 2% content on the surface relative to the weight of the melamine on the top level for best imaging. The results are shown in the table below. The thermoset melamine percentage and thermoplastic polyester percentages were calculated for the top overlay and decorative paper layers.

| Sample Laminate Construction | Thermoset Melamine Percentage (%) | Thermoplastic Polyester Percentage (%) | Dye-sublimation Image Quality |
|---|---|---|---|
| A | 65-70 | 0.0 | None |
| B | 65-70 | 0.5 | Faint |
| C | 65-70 | 1.0 | Very Good |
| D | 65-70 | 2.0 | Very Good |

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for transferring a decorative sublimation dye design formed on a transfer sheet to a substrate, the method comprising providing a substrate treated with a melamine resin, modifying the melamine resin to produce an active dye site for acceptance of a sublimation dye, and transferring the sublimation dye to the active dye site, wherein the modification occurs by addition of a chemical component to change the mole ratio of formaldehyde to melamine in the melamine resin.

2. The method according to claim 1, wherein the substrate is selected from the group consisting of glass, plastic, cement, and wood.

3. The method according to claim 2, wherein the wood is selected from the group consisting of paper, particle board, plywood, isoboard, veneer core, hard board, medium density fiberboard (MDF), and engineered wood.

4. The method according to claim 1, wherein the chemical component is a plasticizer.

5. The method according to claim 4, wherein the plasticizer is a glycol.

6. The method according to claim 5, wherein the glycol is a polyethylene glycol, diethylene glycol, or a combination thereof.

7. The method according to claim 5, wherein the glycol is present in an amount of about 0.02% to about 0.06%.

8. The method according to claim 1, wherein the mole ratio of formaldehyde to melamine in the melamine resin is changed by reducing the mole ratio of formaldehyde to melamine.

9. The method according to claim 1, wherein the mole ratio of formaldehyde to melamine is about 1.10 to about 1.40.

10. The method according to claim 1, wherein further modification occurs by thermofusing a polyester resin with a melamine resin.

11. The method according to claim 10, wherein the polyester resin is a polyethylene terephthalate (PET), a glycol-modified polyethylene terephthalate (PETG), or a combination thereof.

12. The method according to claim 10, wherein the polyester resin is in the form of a sheet.

13. A modified melamine decorative laminate comprising:

a substrate treated with a melamine resin, a polyester layer thermofused to the melamine resin, and a sublimation dye image formed on the thermofused modified melamine substrate, wherein the melamine resin is chemically modified to produce an active dye site for acceptance of the sublimation dye.

14. The modified melamine decorative laminate according to claim 13, wherein the substrate is selected from the group consisting of glass, plastic, cement, and wood.

15. The modified melamine decorative laminate according to claim 14, wherein the wood is selected from the group consisting of paper, particle board, plywood, isoboard, veneer core, hard board, medium density fiberboard (MDF), and engineered wood.

16. The modified melamine decorative laminate according to claim 13, wherein the substrate is a phenolic backer.

17. The modified melamine decorative laminate according to claim 13, wherein the polyester is a polyethylene terephthalate (PET), a glycol-modified polyethylene terephthalate (PETG), or a combination thereof.

* * * * *